US006733008B2

(12) United States Patent
Waragai et al.

(10) Patent No.: US 6,733,008 B2
(45) Date of Patent: May 11, 2004

(54) SHEET CONVEYING APPARATUS, AND IMAGE FORMING APPARATUS AND IMAGE READING APPARATUS HAVING THE SHEET CONVEYING APPARATUS

(75) Inventors: Tsuyoshi Waragai, Shizuoka (JP); Yasuyoshi Hayakawa, Shizuoka (JP); Atsushi Ogata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/873,248

(22) Filed: Jun. 5, 2001

(65) Prior Publication Data

US 2002/0020960 A1 Feb. 21, 2002

(30) Foreign Application Priority Data

Jun. 7, 2000 (JP) ..... 2000-171015

(51) Int. Cl.[7] ..... B65H 9/04
(52) U.S. Cl. ..... 271/242
(58) Field of Search ..... 271/242, 264

(56) References Cited

U.S. PATENT DOCUMENTS 4,394,009 A * 7/1983 Bergman et al. ..... 271/10.12
4,878,657 A * 11/1989 Ura et al. ..... 271/9.13
5,168,290 A * 12/1992 Tanaka et al. ..... 346/134
5,620,174 A * 4/1997 Taniguro et al. ..... 271/10.12
5,692,744 A * 12/1997 Funato ..... 271/242
5,933,697 A * 8/1999 Onodera et al. ..... 399/406

FOREIGN PATENT DOCUMENTS

| | | |
|---|---|---|
| JP | 50-50044 | 5/1975 |
| JP | 60-97149 | 5/1985 |
| JP | 61-12554 | 1/1986 |
| JP | 3-25446 | 3/1991 |

* cited by examiner

*Primary Examiner*—Donald P. Walsh
*Assistant Examiner*—Joseph Rodriguez
(74) *Attorney, Agent, or Firm*—Fitzpatrick, Cella, Harper & Scinto

(57) ABSTRACT

A sheet conveyed by a conveying member is pressed against a registration roller pair in a stop state, thereby forming a loop in a loop formation space between the conveying member and the registration roller pair. A lower member which forms the lower surface of the loop formation space has a shape with which the sheet conveyed by the conveying member moves toward the registration roller pair along an upper member which forms the upper surface of the loop formation space in forming the loop. When the lower member is pressed by the sheet conveyed by the registration roller pair while attenuating the loop, the lower member moves downward.

8 Claims, 10 Drawing Sheets

SHEET CONVEYING APPARATUS, AND IMAGE FORMING APPARATUS AND IMAGE READING APPARATUS HAVING THE SHEET CONVEYING APPARATUS

BACKGROUND OF THE INVENTION

1. Field of the Invention

The present invention relates to a sheet conveying apparatus, and an image reading apparatus and image forming apparatus having the sheet conveying apparatus and, more particularly, to a structure for correcting skew feed of a sheet.

2. Related Background Art

Some conventional image reading apparatuses or image forming apparatuses have a sheet feeding apparatus which corrects skew feed of a sheet by pressing the sheet conveyed by a conveying means against a registration roller pair to form a loop in the sheet and then conveys the sheet by rotating the registration rollers.

FIG. 10 is a view showing the structure of such a conventional sheet feeding apparatus. Referring to FIG. 10, a sheet stocking tray 60 stocks a sheet of paper (not shown). A pickup roller 61 picks up the sheet. A shutter 62 restrains the leading ends of the sheets set on the sheet stocking tray 60 and is released at a predetermined timing. A weight 63 is arranged at a position opposite to the pickup roller 61 and, in feeding the sheet, moves downward and clamps (a batch of) sheets to apply a sheet feeding force to them.

A sheet presence/absence sensor lever 64 is arranged upstream of the shutter 62 to detect the presence/absence of a sheet. When a sheet is abutted against the shutter 62 and set, the sheet presence/absence sensor lever 64 is pressed by the sheet and pivots to shield light to a photointerrupter (not shown). When the light to the photointerrupter is shielded, a signal representing that the light is shielded is input to a control section (not shown). On the basis of the signal, the control section detects that the sheet is set.

A lower guide plate 65 guides the sheet. An upper guide plate 66 guides the sheet. A feed roller 67 feeds the sheet. A separation belt section 68 separates the stocked sheets one by one. A loop formation space 69 allows the sheet to loop to correct skew feed of the sheet. A sheet lower guide plate 70 defines the lower surface of the loop formation space 69. A sheet upper guide plate 75 defines the upper surface of the loop formation space 69.

An ante-registration sensor lever 71 detects the leading end of the sheet separated one by one and conveyed by the feed roller 67 and the separation belt section 68. The ante-registration sensor lever 71 is pressed by the conveyed sheet and pivots to shield light to a photointerrupter (not shown). When the light to the photointerrupter is shielded, a signal representing that the light is shielded is input to a control section. On the basis of the signal, the control section detects that the sheet is conveyed.

A registration roller pair 72, 73 temporarily stop the leading end of the sheet separated one by one and conveyed by the feed roller 67 and the separation belt section 68 and forms a loop in the sheet, thereby correcting skew feed of the sheet. A sheet leading end detection lever 74 detects the leading end of the sheet conveyed by the registration roller pair 72, 73 after the skew feed of the sheet is corrected. The sheet leading end detection lever 74 has the same structure as that of the above-described sheet presence/absence sensor lever 64 or the ante-registration sensor lever 71.

The feed operation of the sheet feeding apparatus having the above arrangement will be described next.

When a user stocks sheets on the sheet stocking tray 60 and sets them by abutting the leading ends of the sheets against the shutter 62, the sheet presence/absence sensor lever 64 is pressed by the sheets and pivots, and the control section detects that the sheets are set. Upon detecting that the sheets are set, the control section makes the shutter 62 pivot downward and the weight 63 move downward and clamp the sheets with the pickup roller 61.

Next, the pickup roller 61 is rotated at a predetermined timing. Each batch of sheets is guided by the lower guide plate 65 and the upper guide plate 66 and conveyed to a feed separation section constituted by the feed roller 67 and the separation belt section 68. After that, the conveyed batch of sheets is separated one by one and conveyed to the registration roller pair 72, 73 by the feed roller 67.

Each conveyed sheet reaches the registration roller pair 72, 73 while making the ante-registration sensor lever 71 pivot. At this time, the registration roller pair 72, 73 are kept in a stop state. The conveyed sheet abuts against the registration roller pair 72, 73, and the leading end of the sheet stops.

Even when the leading end of the sheet stops, the feed roller 67 continuously feeds the sheet for a predetermined time from a time when the leading end of the sheet is detected by the ante-registration sensor lever 71. Hence, a loop is formed in the loop formation space 69 between the registration roller pair 72, 73 and the feed roller 67 to correct skew feed of the sheet.

After the skew feed of the sheet is corrected by forming the loop, the control section rotates the registration roller pair 72, 73. At this time, since the feed roller 67 is kept stopped, the sheet is conveyed only by the registration roller pair 72, 73. As a result, the sheet is conveyed to the next process by the registration roller pair 72, 73 while attenuating the loop.

In such a conventional sheet feeding apparatus, however, a loop is formed in a different manner depending on the type of sheet. For a certain type of sheet, a loop is abruptly formed, and the sheet strongly abuts against the sheet upper guide plate 75 in the loop formation space 69 to generate large noise. If such large noise is generated every time a sheet is fed, the noise level of the apparatus becomes considerably high.

When the registration roller pair 72, 73 rotate after loop formation, the loop of sheet disappears. If the loop abruptly disappears, the sheet strongly abuts against the sheet lower guide plate 70, resulting in larger noise.

A cardboard, a thick sheet of paper, or a strongly rigid sheet remains straight without forming a loop because of its rigidity even when the sheet abuts against the registration roller pair 72, 73 that stand still, and no sufficient loop can be formed. In this case, skew feed of the sheet cannot be sufficiently corrected.

SUMMARY OF THE INVENTION

It is an object of the present invention to provide a sheet feeding apparatus capable of reducing noise and reliably correcting skew feed of a sheet, and an image reading apparatus and an image forming apparatus having the sheet feeding apparatus.

According to the present invention, there is provided a sheet conveying apparatus which corrects skew feed of a sheet by pressing the sheet conveyed by conveying means against a stationary registration roller pair so as to form a loop in the sheet and then rotates the registration roller pair to convey the sheet, comprising a loop formation space provided between the conveying means and the registration roller pair, in which the sheet forms the loop, an upper member for defining an upper surface of the loop formation space, the upper member extending in a direction of the registration roller pair which is to abut against the sheet when the sheet forms the loop, and a lower member for defining a lower surface of the loop formation space, wherein the lower member is designed to move the sheet conveyed by the conveying means toward the registration roller pair along the upper member and move downward when pressed by the sheet conveyed by the registration roller pair while attenuating the loop.

According to the present invention, preferably, the conveying means comprises a conveying member and separation means for separating the sheet upon abutting against the conveying member, and the lower member has an apex which projects upwardly with respect to a line that connects a nip of the registration roller pair and a nip of the conveying member and the separation means.

According to the present invention, the apparatus may preferably include one or a plurality of runners rotatably arranged at the apex of the lower member.

According to the present invention, the apparatus may preferably include an elastic member for biasing the lower member upward.

According to the present invention, there is also provided a sheet conveying apparatus comprising registering means for correcting skew feed of a sheet by restraining a leading end of the sheet conveyed by conveying means so as to form a loop in the sheet and then conveying the sheet, a first guide for guiding the sheet to the registering means, the first guide abutting against a projecting surface of the sheet which forms the loop, and a second guide for guiding the sheet and causing the sheet to abut against the first guide before abutting against the registering means, wherein the second guide moves when pressed by the sheet conveyed by the registering means while attenuating the loop.

According to the present invention, an image reading apparatus may preferably include any one of the above sheet conveying apparatuses and an image reading section for reading an image formed on a sheet conveyed by the sheet conveying apparatus.

According to the present invention, an image forming apparatus may include any one of the above sheet conveying apparatuses and an image forming section for forming an image on a sheet conveyed by the sheet conveying apparatus.

As in the present invention, a sheet conveyed by a conveying means is pressed against a stationary registration roller pair, thereby forming a loop in the sheet in a loop formation space between the conveying means and the registration roller pair. A lower member which defines the lower surface of the loop formation space has a shape with which the sheet conveyed by the conveying member moves toward the registration roller pair along an upper member which defines the upper surface of the loop formation space in forming the loop. When the lower member is pressed by the sheet conveyed by the registration roller pair while attenuating the loop, the lower member moves downward.

DESCRIPTION OF THE PREFERRED EMBODIMENTS

The embodiments of the present invention will be described below in detail with reference to the accompanying drawings.

Figure 1:
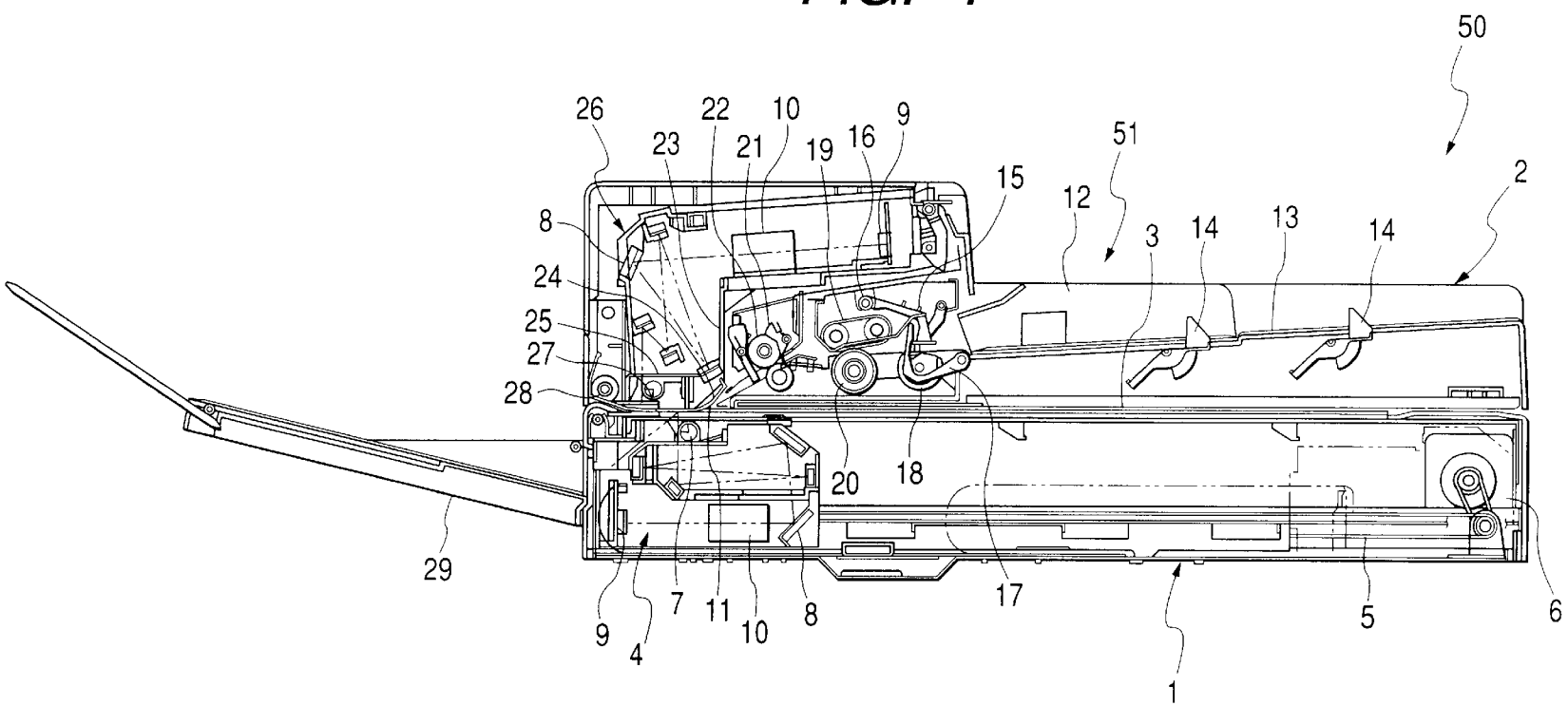
FIG. 1 is a view showing the arrangement of an image reading apparatus having a sheet feeding apparatus according to the first embodiment of the present invention.

FIG. 1 is a view showing the arrangement of an image reading apparatus having a sheet feeding apparatus according to the first embodiment of the present invention.

Referring to FIG. 1, an image reading apparatus 50 has a flatbed image read section (to be referred to as an FB hereinafter) 1 capable of fixing an original as a sheet with an image formed thereon and reading the image on the original, an auto original feeder (to be referred to as an ADF hereinafter) 2 attached to the upper surface of the FB 1 to feed stocked originals to a predetermined read section one by one, and a sheet feeding apparatus 51.

Referring to FIG. 1, an original glass stand 3 is arranged on the upper surface of the FB 1. A first optical carriage 4 scans the original on the original glass stand 3. A drive belt 5 transmits drive to move the first optical carriage 4. A carriage drive motor 6 drives the drive belt 5. A lamp 7 is arranged on the upper surface of the first optical carriage 4. A reflecting mirror 8 guides light emitted from the lamp and reflected by the original to a predetermined optical path.

A CCD 9 converts an image obtained by receiving the light guided by the reflecting mirror 8 into an electrical signal. A condenser lens 10 condenses the light reflected by the reflecting mirror 8 to the CCD 9. An original butt reference plate 11 is arranged on the original glass stand 3 to read the image on the original glass stand 3. An original side regulating plate 12 is arranged in the ADF 2 to regulate the original position in the widthwise direction. The sheet feeding apparatus has an original stocking tray 13. An original length detection lever 14 is arranged on the original stocking tray 13 to detect the length of the original.

An original conveying upper guide 24 is opposed to the original glass stand 3. The image is read while conveying the original through a predetermined gap formed between the original glass stand 3 and the original conveying upper guide 24. At a first read point 25, the image on one side of the original is read by the first optical carriage 4.

A second optical carriage 26 is opposed to the first optical carriage 4 with the original interposed therebetween. The second optical carriage 26 has the reflecting mirror 8, CCD 9, and the like which are identical to those of the first optical carriage 4. At a second read point 27, the image on the other side of the original is read by the second optical carriage 26.

A delivery roller pair 28 deliver the original read by the FB 1 outside of the apparatus. A delivery tray 29 is provided on a side of the FB 1 and extended outside the apparatus. The original delivered by the delivery roller pair 28 is piled on the delivery tray 29.

Figure 2:
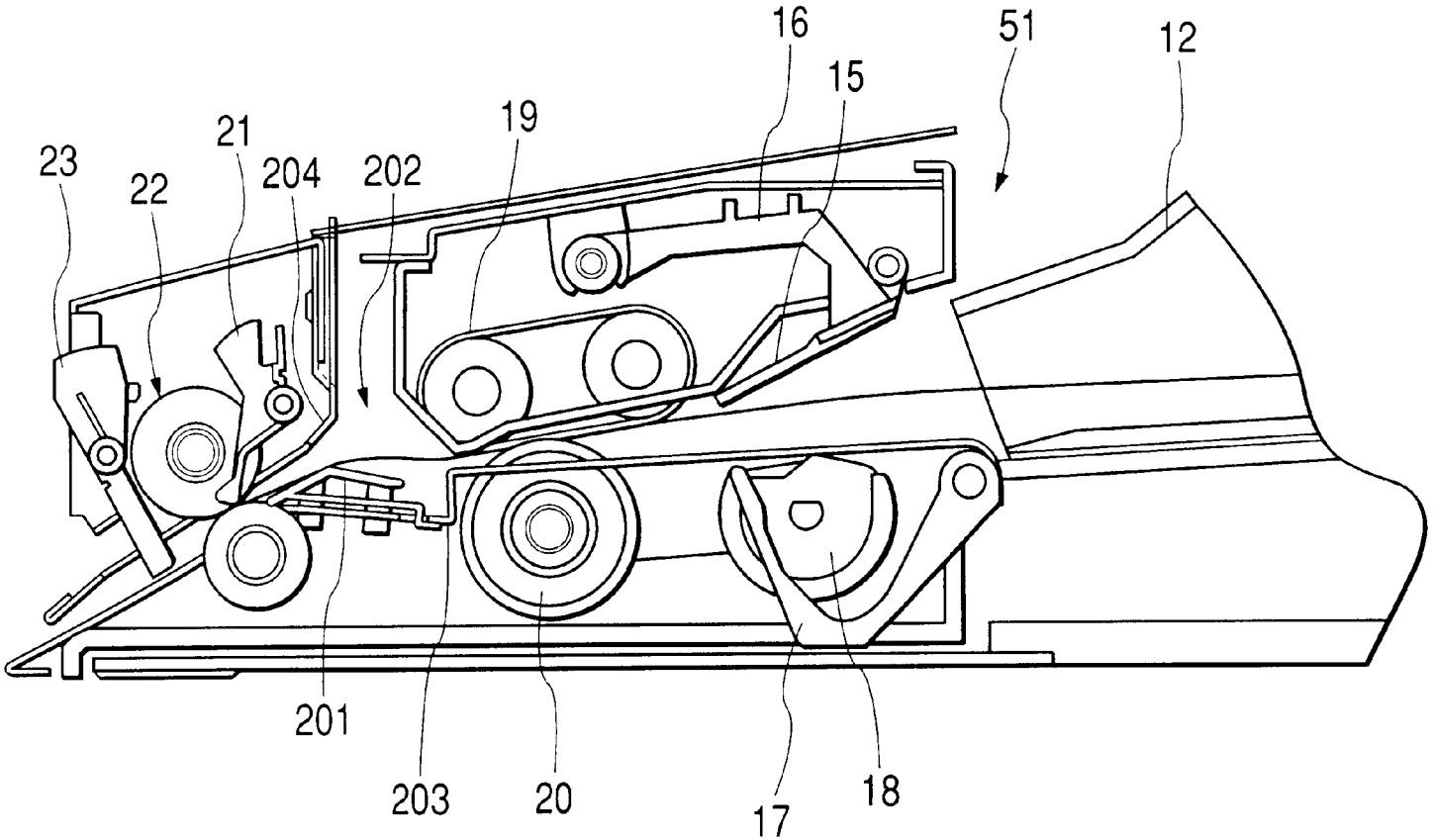
FIG. 2 is a view showing the arrangement of the sheet feeding apparatus.

FIG. 2 is a view showing the arrangement of the sheet feeding apparatus 51. Referring to FIG. 2, an original presence/absence sensor lever 15 detects the leading end of an original to detect the presence/absence of the original. A weight 16 presses the leading end of the original from the upper side. An original shutter 17 restrains the leading end of the original and is released at a predetermined timing.

A sheet pickup roller 18 feeds stocked originals from the lowermost sheet. A separation belt 19 serves as a separation means rotated in a direction opposite to the original conveying direction. A feed roller 20 is a conveying member which is opposed to the separation belt 19 and constructs a conveying means together with the separation belt 19.

An ante-registration sensor lever 21 detects the leading end of the original separated one by one and conveyed by the feed roller 20 and the separation belt 19 to determine the loop formation timing. A registration roller pair 22 serves as registering means. An original leading end detection lever 23 detects the leading end of the original conveyed by the registration roller pair 22.

A loop formation space 202 is provided between the registration roller pair 22 and the conveying means (feed roller 20 and separation belt 19) to make the original form a loop. An ante-registration guide member 201 is arranged upstream of the registration roller pair 22 and serves as a lower member or the second guide for defining the lower surface of the loop formation space 202. The ante-registration guide member 201 is elastically attached to a stay (not shown) of the sheet feeding apparatus 51.

An upper guide member 204 serves as an upper member or the first guide which extends in the direction of registration roller pair 22 and defines the upper surface of the loop formation space 202. The original forms a loop while abutting against the upper guide member 204.

The image reading operation of the image reading apparatus 50 having the above arrangement will be described next by exemplifying an original flow-reading mode.

In the flow-reading mode, when the user puts originals on the original stocking tray 13 of the ADF 2, the ADF 2 detects that the originals are placed on the original stocking section 13 by the original length detection sensor 14 and the original presence/absence sensor 15. When the user sets the width of the originals by the original side regulating plate 12, the size of the original is detected in coordination with detection by the original length detection sensor 14.

In this state, when the user presses an original read start button (not shown), in response to a control signal from a control section (not shown) provided in the image reading apparatus 50 or ADF 2, the original shutter 17 that has regulated the original leading ends pivots downward, and the weight 16 moves downward. A batch of originals are clamped by the weight 16 and the sheet pickup roller 18. When the sheet pickup roller 18 rotates, the originals are conveyed to a separation conveying section formed from the separation belt 19 and the feed roller 20.

The originals are detected by the ante-registration sensor lever 21 and separated one by one and fed by the separation belt 19 and the feed roller 20, as shown in FIG. 2, so the leading end of an original S reaches the registration roller pair 22 which is kept in the stop state. Even when the leading end of the original S stops, the feed roller 20 continuously feeds the original S for a predetermined time from a time when the leading end of the sheet is detected by the ante-registration sensor lever 21 and then stops. Hence, a loop of the original S is formed in the loop formation space 202 between the registration roller pair 22 and the feed roller 20.

After loop formation, when the registration roller pair 22 starts rotating at a predetermined timing, conveyance of the original S starts. The leading end of the conveyed original S is guided to the first original read point 25 by the original conveying upper guide 24 shown in FIG. 1.

The original is conveyed by the registration roller pair 22 and detected by the original leading end detection sensor 23. A control section (not shown) determines the time in which the original reaches the original read position on the basis of the detection signal from the original leading end detection sensor 23. Read operation by the first and second optical carriages 4 and 26 is started in register with the determined time.

Simultaneously with conveyance of the original, the first and second optical carriages 4 and 26 perform an initial operation to be described below. That is, when the original is read by the ADF 2, the first optical carriage 4 is designated and controlled to perform shading correction after the user depresses the original read start button and before the original reaches the original read point 25.

More specifically, the first optical carriage 4 turns on the lamp 7, is moved to the position of the white reference plate 11 to correct the white reference (shading), then is moved to the first read point 25, and waits for arrival of the original. Like the first optical carriage 4, the second optical carriage 26 corrects white reference before the original reaches the second read point 27, then is moved to the second read point 27, and waits for arrival of the original.

After the first and second optical carriages 4 and 26 execute the initial operation, the original reaches the first read point 25. When the original passes through the first read point 25 at a predetermined conveyance speed, the image on one side of the original is sequentially read by the first optical carriage 4. When the original reaches the second read point 27, the image on the other side of the original is sequentially read by the second optical carriage 26.

The original that has passed through the second read point 27 is conveyed by the delivery roller pair 28 and delivered onto the delivery tray 29 after all images of the original are read. A series of processes in the original flow-reading mode have been described above.

Before the original is conveyed to the original read position, the feed roller 20 presses the original against the stationary registration roller pair 22 to correct any skew feed of the original. When the original is pressed against the registration roller pair 22 that is in the stop state, a loop of the original is formed, and the leading end of the original is ensured to be run parallel to and pushed into the nip of the registration roller pair 22.

Figure 3:
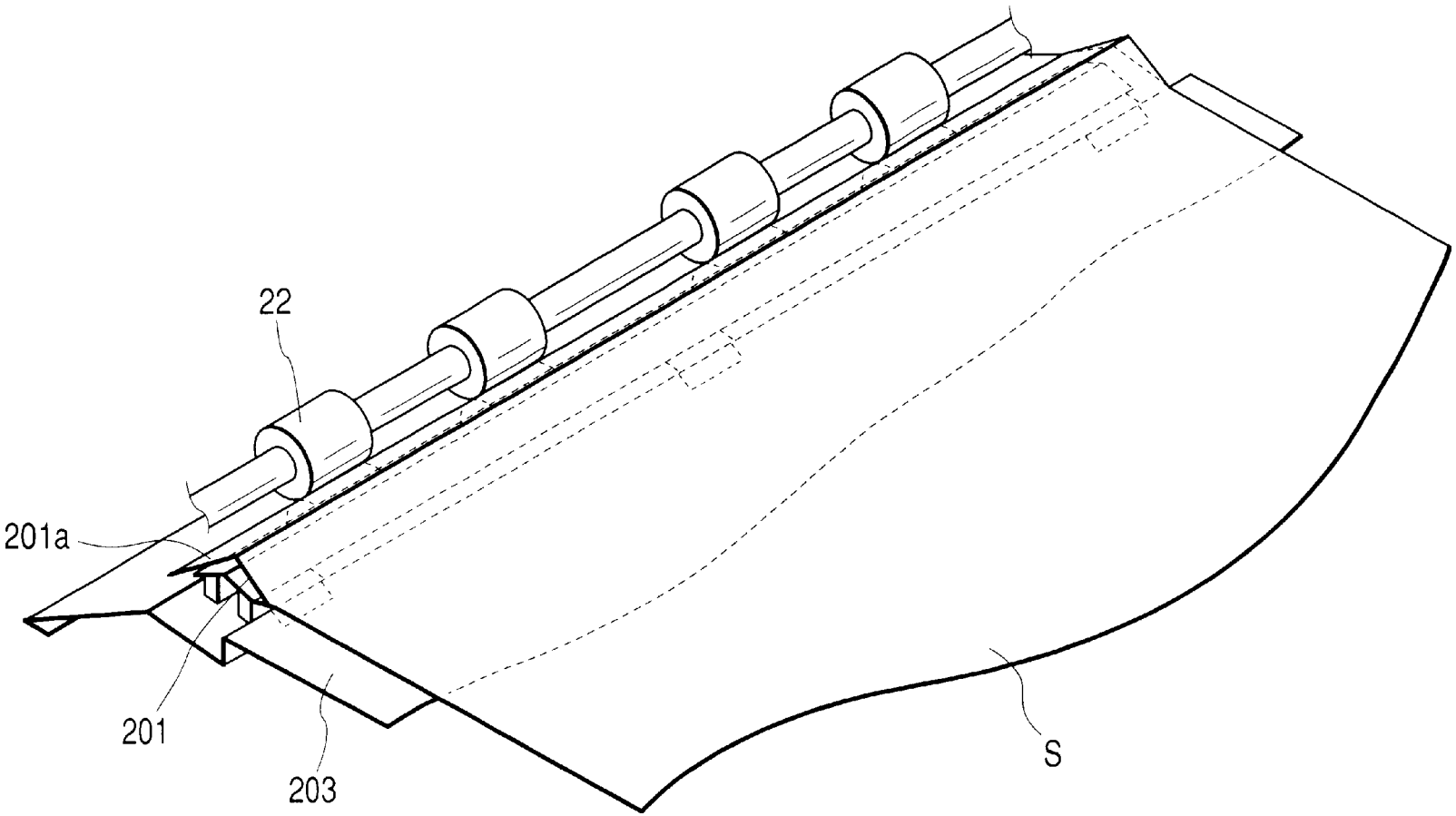
FIG. 3 is a perspective view for explaining the structure of the loop formation section of the sheet feeding apparatus.

In this embodiment, the ante-registration guide member 201 has an apex 201*a*, as shown in FIG. 3. The apex 201*a* projects upwardly with respect to a line that connects the nip of the registration roller pair 22 and the nip of the feed roller 20 and the separation belt 19, as shown in FIG. 2, such that the original conveyed by the feed roller 20 is moved toward the upper guide member 204.

With this structure of the ante-registration guide member 201, when the original S is conveyed by the feed roller 20, the leading end of the original passes through the apex 201*a* of the ante-registration guide member 201 and abuts against the upper guide member 204, and then abuts against the registration roller pair 22 while being guided by the upper guide member 204.

Figure 4:
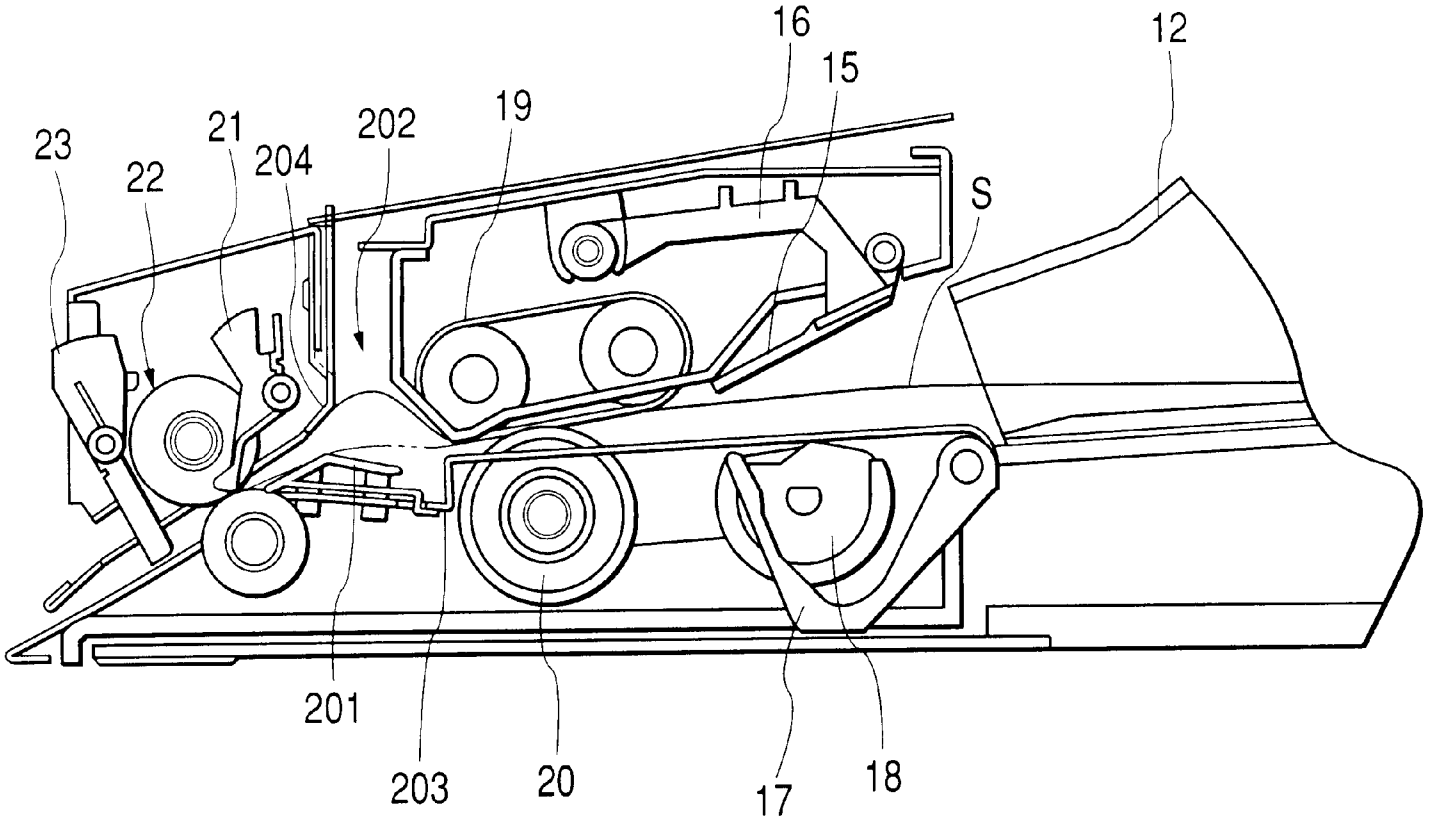
FIG. 4 is a view for explaining a loop formation operation in the sheet feeding apparatus.

When the leading end of the original abuts against the registration roller pair 22 while being guided by the upper guide member 204, the lower surface of the original S curves at the apex 201*a* of the ante-registration guide member 201 as a point of support and is bent. When the original is bent and the feed roller 20 further rotates, the original S forms a loop, as shown in FIG. 4.

As the apex 201*a* of the ante-registration guide member 201 projects upwardly with respect to the line that connects the nip of the registration roller pair 22 and the nip of the feed roller 20 and the separation belt 19 so that the original S abuts against the registration roller pair 22 while being guided by the upper guide member 204, even the original S formed from a cardboard or a strongly rigid sheet can form a loop, and skew feed can be reliably corrected.

Figure 5:
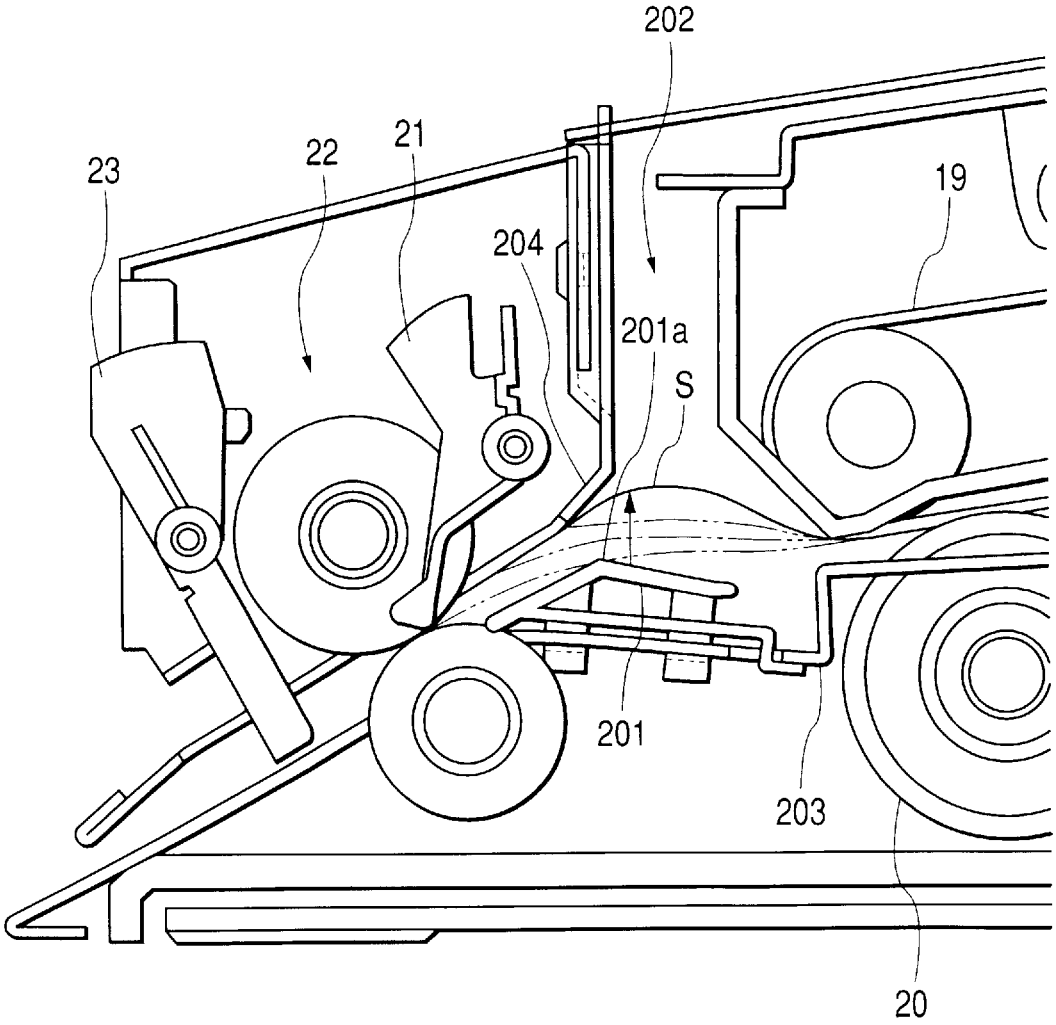
FIG. 5 is a view showing a loop formation in the sheet feeding apparatus.

Since the original S gradually forms a loop from the leading end portion along the upper guide member 204, as shown in FIG. 5, i.e., since the loop of original S is not abruptly formed, the original S does not collide against the upper guide member 204 and generate large noise. In this embodiment, the loop formation space 202 is large to facilitate formation of a loop of the original S.

As the ante-registration guide member 201 is designed to facilitate a formation of a loop in the original S, skew feed of the original S can be reliably corrected, and any noise generated by the original S which collides against the upper guide member 204 due to abrupt loop formation can be prevented.

After a predetermined loop is formed, the feed roller 20 is stopped. Then, after the state wherein the loop in the original is kept formed for a predetermined time, the registration roller pair 22 starts rotating in the conveyance direction at a predetermined timing. The loop amount of the original gradually decreases as the registration roller pair 22 rotates. At this time, rotation of the feed roller 20 is kept stopped.

When the loop amount decreases, the original abuts against the apex of the ante-registration guide member 201. The original S presses the ante-registration guide member 201 as the loop disappears. The series of operations are instantaneously performed by conveyance by the registration roller pair 22. For this reason, the loop in the original S abruptly disappears, and the loop portion of the original collides against the ante-registration guide member 201.

The ante-registration guide member 201 is elastically attached to the stay (not shown), as described above. In this embodiment, one end of the ante-registration guide member 201 is pivotally supported by the stay while being biased upward. Normally, the pivotal end of the ante-registration guide member 201 engages with, e.g., an engaging member 203 shown in FIG. 6.

Figure 6:
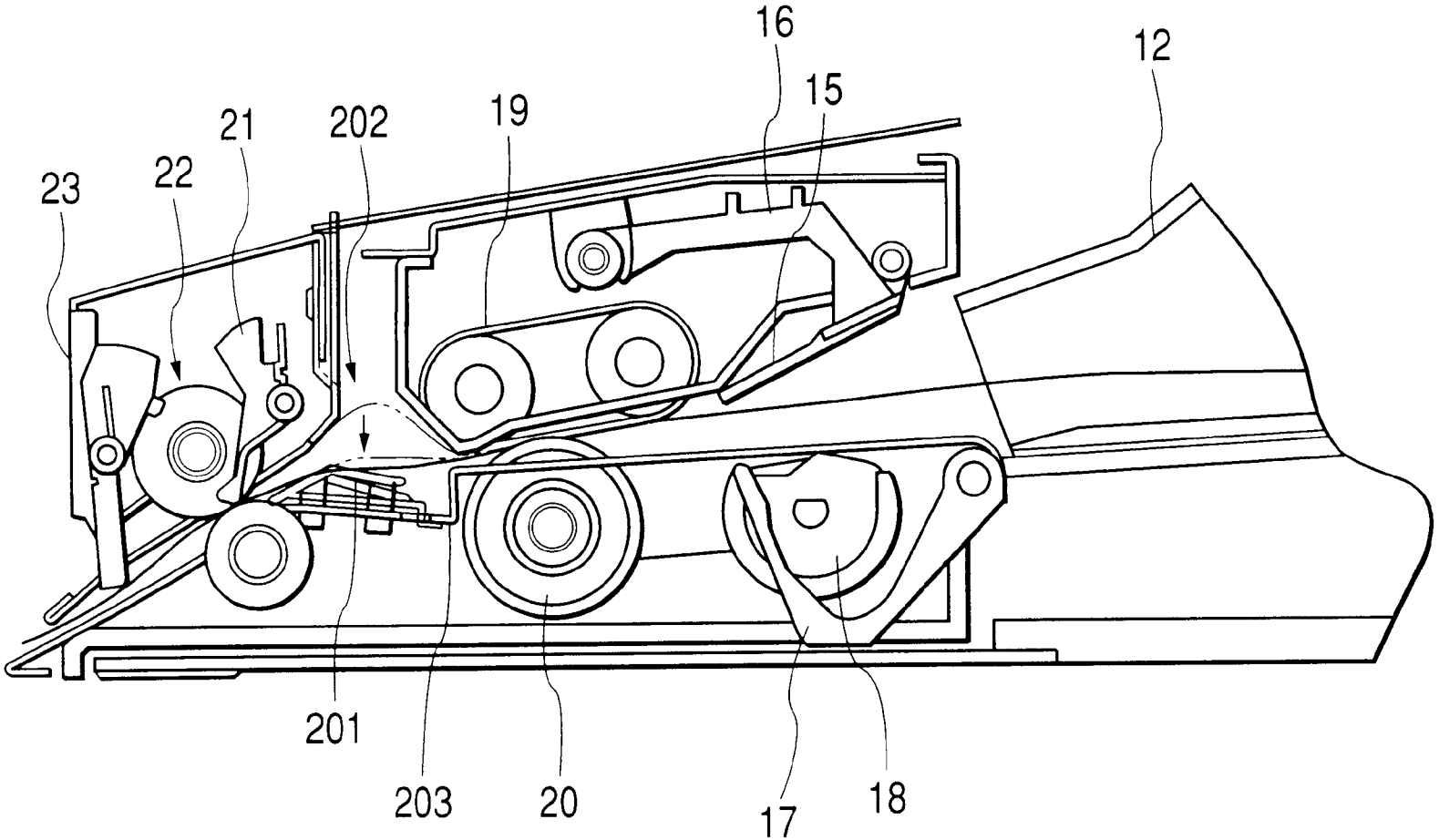
FIG. 6 is a view for explaining a loop attenuation operation in the sheet feeding apparatus.

For this reason, when the original S collides against the ante-registration guide member 201, as shown in FIG. 6, the ante-registration guide member 201 is elastically deflected downward. Even when the original S abruptly collides against the ante-registration guide member 201 due to the abrupt disappearance of the loop, collision noise considerably decreases because the ante-registration guide member 201 can be deflected.

As the ante-registration guide member 201 is elastically supported, collision noise between the original S and the ante-registration guide member 201 at the time of loop disappearance can be decreased.

In the arrangement of this embodiment, during the process in which the original starts abutting against the ante-registration guide member 201 and pressing the ante-registration guide member 201, a conveyance resistance may be generated because the original rubs against the apex 201*a* of the ante-registration guide member 201.

This is especially conspicuous for an original having a rough surface or a special sheet (e.g., OHT) other than a normal sheet. The second embodiment of the present invention will be described next, in which even when an original having a rough surface or a special sheet other than a normal sheet is conveyed, the conveyance resistance can be greatly reduced.

Figure 7:
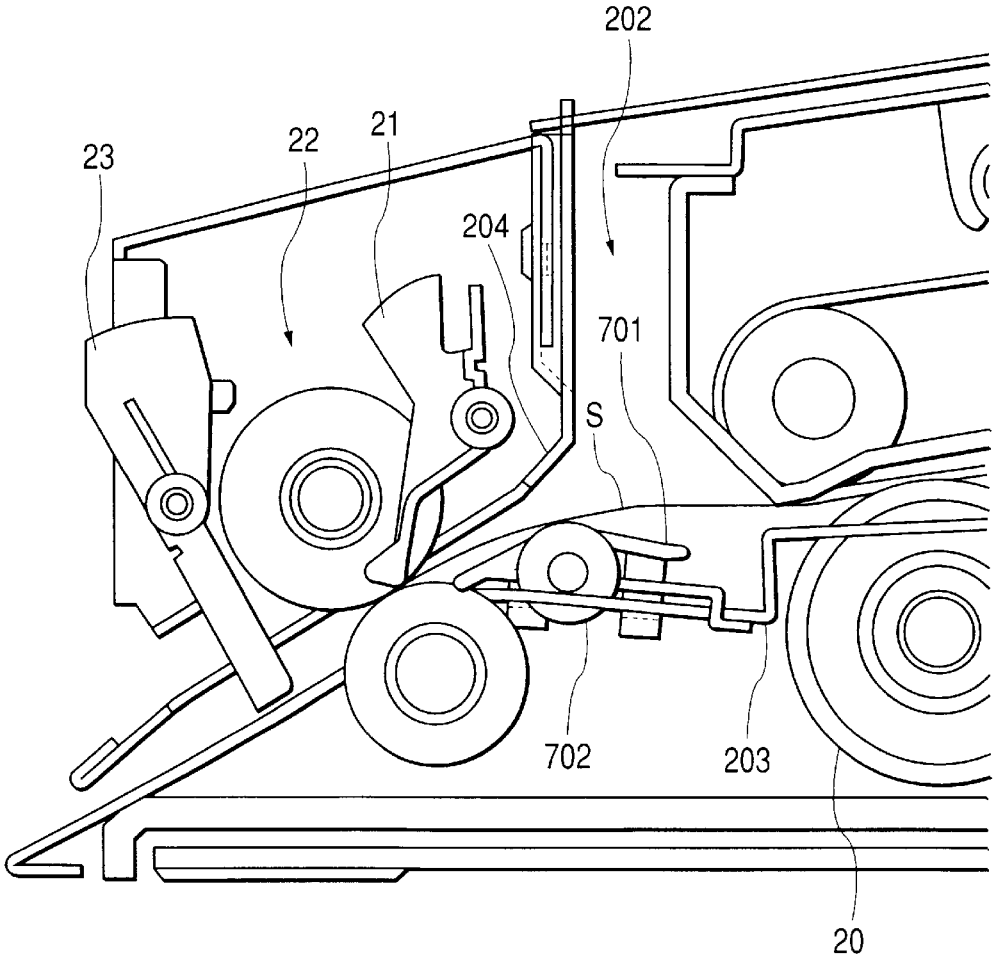
FIG. 7 is a view showing the arrangement of a sheet feeding apparatus according to the second embodiment of the present invention.

FIG. 7 is a partial enlarged view of a sheet feeding apparatus according to the second embodiment. The same reference numerals as in FIG. 2 denote the same or equivalent parts in FIG. 7.

Figure 8:
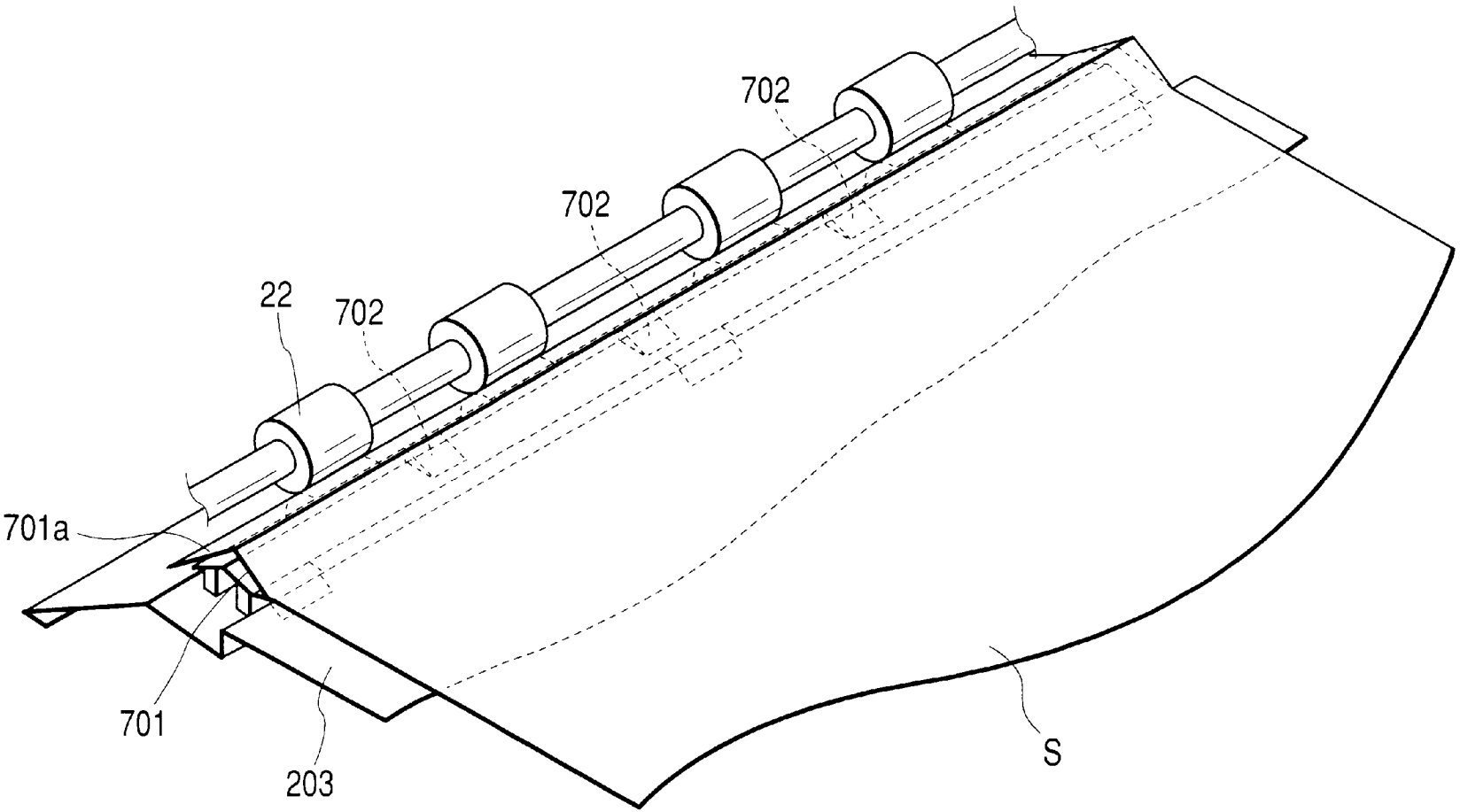
FIG. 8 is a perspective view for explaining the structure of the loop formation section of the sheet feeding apparatus.

Referring to FIG. 7, the apparatus has an ante-registration guide plate 701. One or a plurality of runners 702 are rotatably provided at an apex 701*a* of the ante-registration guide plate 701 and are aligned in a direction perpendicular to the conveyance direction of an original S, as shown in FIG. 8. In this embodiment, three runners 702 are arranged.

When the runners 702 are arranged at the apex 701*a* of the ante-registration guide plate 701, the original S which is conveyed toward an upper guide member 204 by a feed roller 20 does not rub against the apex of the ante-registration guide plate 701. In addition, when the loop disappears as a registration roller pair 22 rotates, the original S gradually abuts against the runners 702 and presses the ante-registration guide plate 701. Since the runners 702 can freely rotate, the conveyance resistance to the registration roller pair 22 can be considerably reduced.

As the runners 702 are arranged at the apex 701*a* of the ante-registration guide plate 701, the conveyance resistance can be considerably reduced even when an original having a rough surface or a special sheet other than a normal sheet is conveyed.

The third embodiment of the present invention will be described next.

Figure 9:
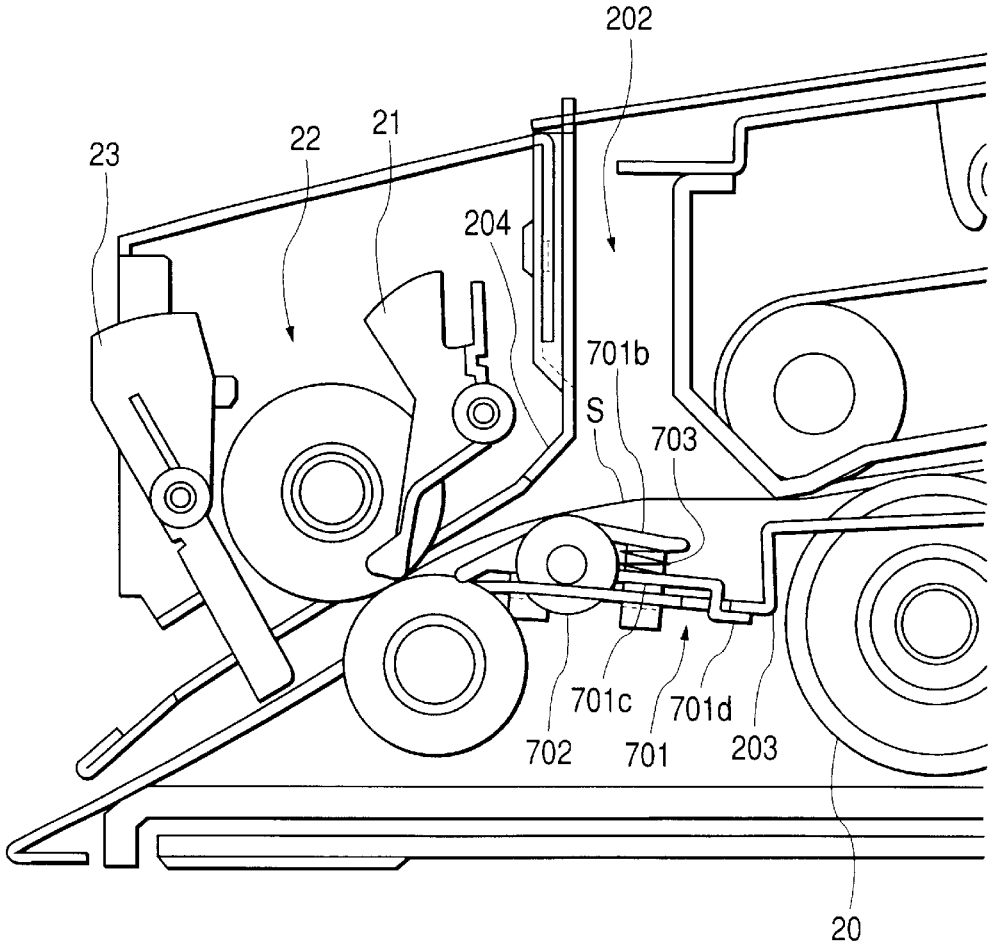
FIG. 9 is a view showing the arrangement of a sheet feeding apparatus according to the third embodiment of the present invention.
Figure 10:
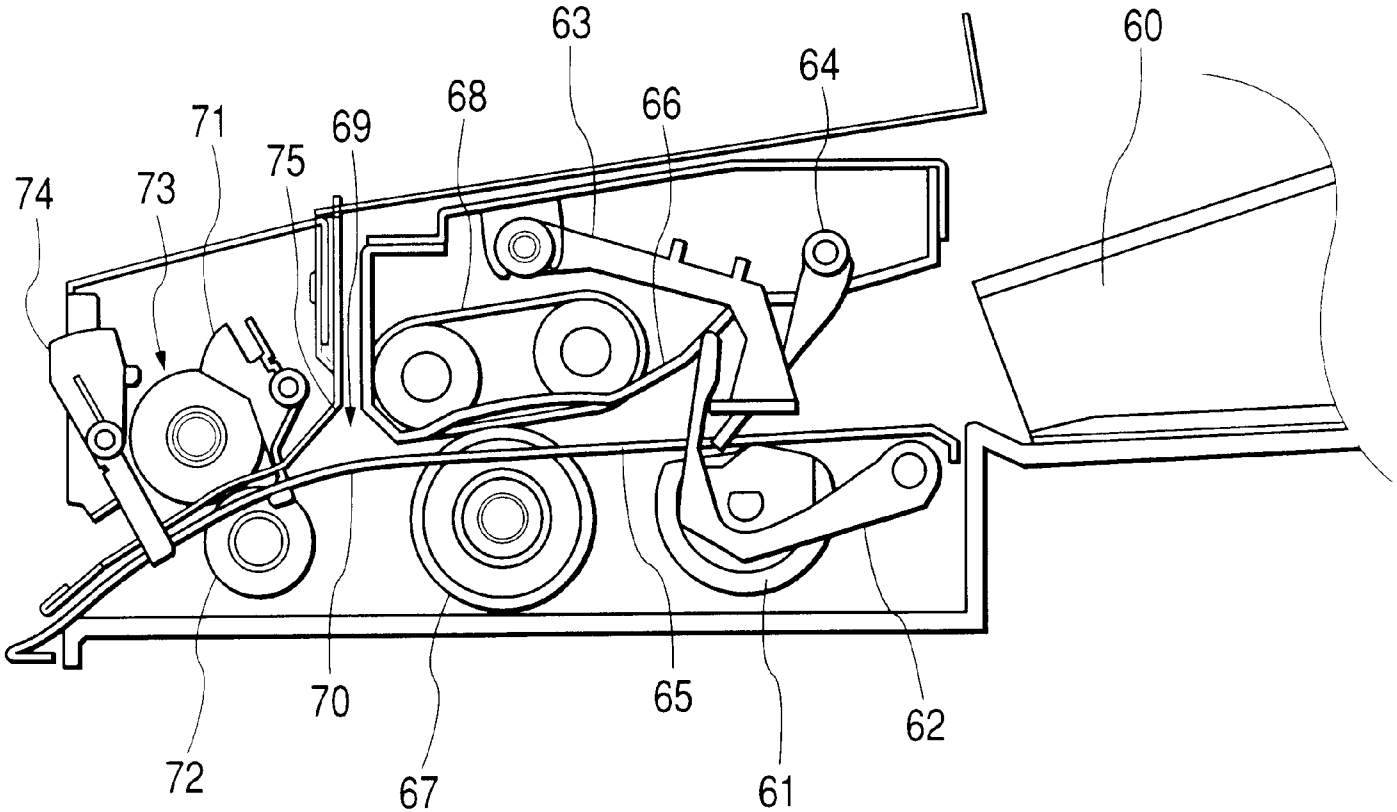
FIG. 10 is a view showing the arrangement of a conventional sheet feeding apparatus.

FIG. 9 is an enlarged view of a sheet feeding apparatus according to the third embodiment. The same reference numerals as in FIG. 7 denote the same or equivalent parts in FIG. 9.

Referring to FIG. 9, an original guide section 701*b* of an ante-registration guide plate 701 guides an original S. An engaging portion 701*c* of the ante-registration guide plate 701 has at its distal end an engaging claw 701*d* engaging with an engaging member 203. A spring 703 for bringing the original guide section 701*b* upward by a predetermined pressing force is interposed between the original guide section 701*b* and the engaging portion 701*c*.

When the spring 703 is arranged, the impulse absorbing capability for the original S at the time of loop disappearance can be improved. This structure can cope with a case wherein the swing performance of the ante-registration guide plate 701 changes due to durability, and can also flexibly cope with various types of sheets including thin and thick sheets.

A sheet feeding apparatus arranged in an image reading apparatus has been described above. However, the present invention is not limited to this. For example, the sheet feeding apparatus may be arranged in an image forming apparatus having an image forming section for forming an image by an electrophotographic process or the like. The registering means is not limited to the registration roller pair. A shutter which abuts against the leading end of a fed sheet, restrains the leading end to form a loop in the sheet, and then retreats, and a conveying means such as a roller pair for conveying the sheet after the shutter retreats may be combined to form the registering means.

The upstream conveying means for conveying the sheet to the registration rollers (registering means) need not always be a feed roller for separating one of the stocked sheets one by one and feeding the sheet and may be a conveyance roller pair for conveying the sheet.

In the above embodiment, while the registering means is conveying the sheet, the feed roller is kept stopped. However, when the registering means is conveying the sheet, the upstream conveying means may decrease the loop amount by conveying the sheet at a speed lower than that of the registering means.

As described above, according to the above embodiments, the sheet abuts against the registration roller pair while being guided by the lower member which defines the lower surface of the loop formation space and the upper member which defines the upper surface of the loop formation space, thereby reliably forming a loop in the sheet. Hence, skew feed of the sheet can be reliably corrected. In addition, since abrupt loop formation can be prevented, noise generated by collision between the sheet and the upper member can be prevented.

Furthermore, when the lower member is pressed by the sheet which is conveyed by the registration roller pair while attenuating the loop in the sheet, the lower member is moved downward. Hence, noise generated by collision between the sheet and the lower member can be reduced.

As has been described above, according to the present invention, collision noise of the sheet which is conveyed while attenuating the loop in the sheet can be reduced.

What is claimed is:

1. A sheet conveying apparatus which corrects skew feed of a sheet by pressing the sheet conveyed by conveying means against a stationary registration roller pair to form a loop in the sheet and then rotates said registration roller pair to convey the sheet, said apparatus comprising:

a loop formation space, which is disposed downstream of said conveying means and upstream of said registration roller pair, in which the sheet forms the loop;

an upper member for defining an upper surface of said loop formation space, said upper member extending in a direction of said registration roller pair, which abuts against the sheet when the sheet forms the loop;

a lower member, which is biased upward, for defining a lower surface of the loop formation space;

an engaging member for engaging said lower member, which is biased upward; and an elastic member for biasing said lower member upward, wherein said lower member directs the sheet conveyed by said conveying means toward said registration roller pair and along said upper member, is moved downward when abutted against a surface of the sheet that forms an inside of the loop, and is pressed by the sheet conveyed by said registration roller pair while said registration roller pair attenuates the loop in the sheet.

2. An apparatus according to claim 1, wherein said conveying means comprises a conveying member and separation means for separating the sheet upon abutting against said conveying member, and said lower member has an apex which projects upwardly with respect to a line that connects a nip of said registration roller pair and a nip of said conveying member and said separation means.

3. An apparatus according to claim 1, further comprising one or a plurality of runners rotatably arranged at an apex of said lower member.

4. An apparatus according to claim 1, further comprising a sheet sensor for detecting the sheet, wherein said conveying means conveys the sheet for a predetermined time sufficient to form the loop in the sheet, the predetermined time starting with a time the sheet is detected by said sheet sensor.

5. A sheet conveying apparatus comprising:

registering means for correcting skew feed of a sheet by restraining a leading end of the sheet conveyed by conveying means to form a loop in the sheet and then conveying the sheet;

a first guide, which is disposed downstream of said conveying means and upstream of said registering means, for guiding the sheet to said registering means, said first guide abutting against a swollen surface of the sheet, which forms the loop;

a second guide, which is disposed opposite to said first guide and is biased toward said first guide, for guiding the sheet and causing the sheet to abut against said first guide before abutting against said registering means;

an engaging member for engaging said second guide, which is biased toward said first guide; and an elastic member for biasing said second guide toward said first guide, wherein said second guide is moved when abutted against a surface of the sheet opposite to the swollen surface, and is pressed by the sheet conveyed by said registering means while said registering means attenuates the loop in the sheet.

6. An image reading apparatus comprising:

a sheet conveying apparatus as recited in any one of claims 1 to 3 or 5; and an image reading section for reading an image formed on a sheet conveyed by said conveying apparatus.

7. An image forming apparatus comprising:

a sheet conveying apparatus as recited in any one of claims 1 to 3 or 5; and an image forming section for forming an image on a sheet conveyed by said sheet conveying apparatus.

8. An apparatus according to claim 5, further comprising a sheet sensor for detecting the sheet, wherein said conveying means conveys the sheet for a predetermined time sufficient to form the loop in the sheet, the predetermined time starting with a time the sheet is detected by said sheet sensor.

* * * * *